US005092001A

United States Patent [19]

Ross et al.

[11] Patent Number: 5,092,001

[45] Date of Patent: Mar. 3, 1992

[54] INFANT BATHING APPARATUS

[76] Inventors: Lucy M. Ross; Randy C. Ross, both of 3130 Segovia St., Coral Gables, Fla. 33134

[21] Appl. No.: 478,165

[22] Filed: Feb. 8, 1990

[51] Int. Cl.[5] ..... A47K 3/024; A47K 3/02

[52] U.S. Cl. ..... 4/572.1; 4/571.1; 4/559

[58] Field of Search ..... 4/571, 572, 661, 546–548, 4/549, 553, 584, 586–588, 576–577, 559, 573

[56] References Cited

U.S. PATENT DOCUMENTS

| | | | |
|---|---|---|---|
| Re. 32,806 | 12/1988 | Gurolnick | 4/572 |
| 1,086,628 | 2/1914 | Tate | 4/572 X |
| 1,139,576 | 5/1915 | Presson | 4/586 |
| 1,427,598 | 8/1922 | Jackson | 1/551 |
| 1,512,068 | 10/1924 | Thornburg | 4/589 |
| 1,812,971 | 7/1931 | McCandless | 4/551 |
| 1,870,488 | 8/1932 | Bleustein | 4/548 |
| 1,881,405 | 10/1932 | Haring | 4/551 |
| 2,006,169 | 6/1935 | Harris-Jones | 4/559 |
| 2,102,959 | 12/1937 | Kennedy | 4/572 |
| 2,178,468 | 10/1939 | Bukolt | 4/548 |
| 2,182,669 | 12/1939 | Kennedy | 4/586 |
| 2,203,222 | 6/1940 | Kennedy | 4/586 |
| 2,229,411 | 1/1941 | Hughes | 138/95 |
| 2,358,003 | 9/1944 | DePuy | 4/572 |
| 2,460,308 | 2/1949 | Pribil | 4/572 |
| 2,468,742 | 5/1949 | Faulhaber | 4/572 |
| 2,487,228 | 11/1949 | Feichtmeir | 4/586 |
| 2,507,848 | 5/1950 | Bashaw | 4/572 |
| 2,547,564 | 4/1951 | Burke | 4/572 |
| 2,581,883 | 1/1952 | Rechler | 4/587 X |
| 2,661,482 | 12/1953 | Zimov | 4/586 |
| 2,724,124 | 11/1955 | Whitten | 4/572 X |
| 2,760,208 | 8/1956 | Mussells | 4/572 |
| 2,765,475 | 10/1956 | Nolan | 4/572 |
| 2,828,489 | 4/1958 | Baker | 4/589 |
| 2,973,889 | 3/1961 | Phillips | 4/572 |
| 3,239,850 | 3/1966 | Kiss | 4/559 |
| 3,392,408 | 7/1968 | Stiphany | 4/572 |
| 3,528,111 | 9/1970 | Chou | 4/572 |
| 3,545,016 | 12/1970 | Schorken | 4/659 |
| 3,837,019 | 9/1974 | Hoff | 4/572 |
| 3,890,660 | 6/1975 | Pedler | 4/572 X |
| 3,995,331 | 12/1976 | Fotre et al. | 4/572 |
| 4,266,306 | 5/1981 | Lee | 4/572 |
| 4,373,221 | 2/1983 | Wilson | 4/571 |
| 4,391,006 | 7/1983 | Smith | 4/571 X |
| 4,551,108 | 11/1985 | Bass | 4/573 X |
| 4,561,135 | 12/1985 | Adriaansen | 4/572 |
| 4,602,392 | 7/1986 | Grier et al. | 4/579 |
| 4,656,678 | 4/1987 | Lipski | 4/559 X |
| 4,932,086 | 6/1990 | Berqkvist | 4/572 |

FOREIGN PATENT DOCUMENTS

| | | | |
|---|---|---|---|
| 2203752 | 8/1973 | Fed. Rep. of Germany | 4/572 |

*Primary Examiner*—Henry J. Recla
*Assistant Examiner*—David J. Walczak
*Attorney, Agent, or Firm*—George A. Teacherson

[57] ABSTRACT

Portable bathing apparatus for infants is disclosed. The bathing apparatus is primarily intended to be locatable at the height of the rim of a conventional bathtub and positioned such that the child is positioned in a semi-sitting position along the longitudinal length of the bathtub. With the infant bathing apparatus in place, sufficient room exists within the bathtub so that an adult may simultaneously bath with the child. Extendable appendages at the side thereof allow the bathing apparatus to fit across the rim of the bathtub. In another embodiment of the infant bathing apparatus, legs which may comprise the repositioned appendages may be fitted to and extend from the underside of the bathing apparatus to form an elevated bathing device which fits within the bathtub.

9 Claims, 3 Drawing Sheets

FIG. 3
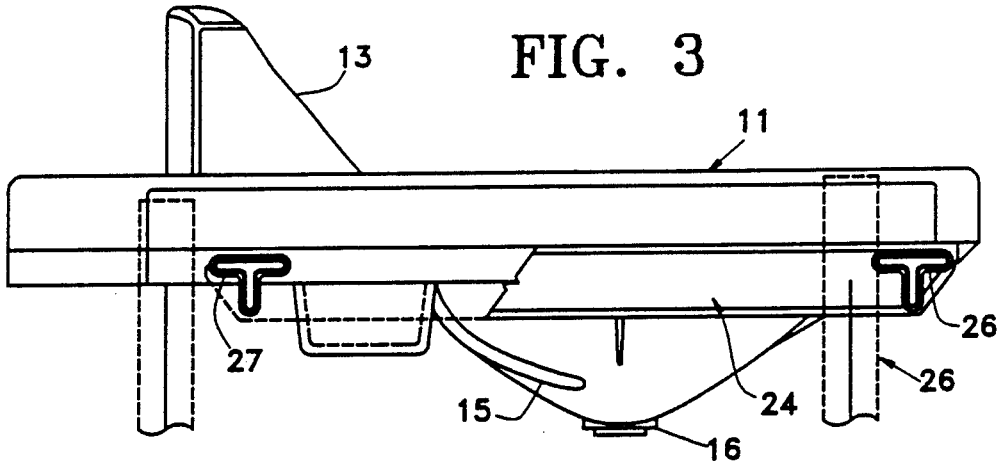
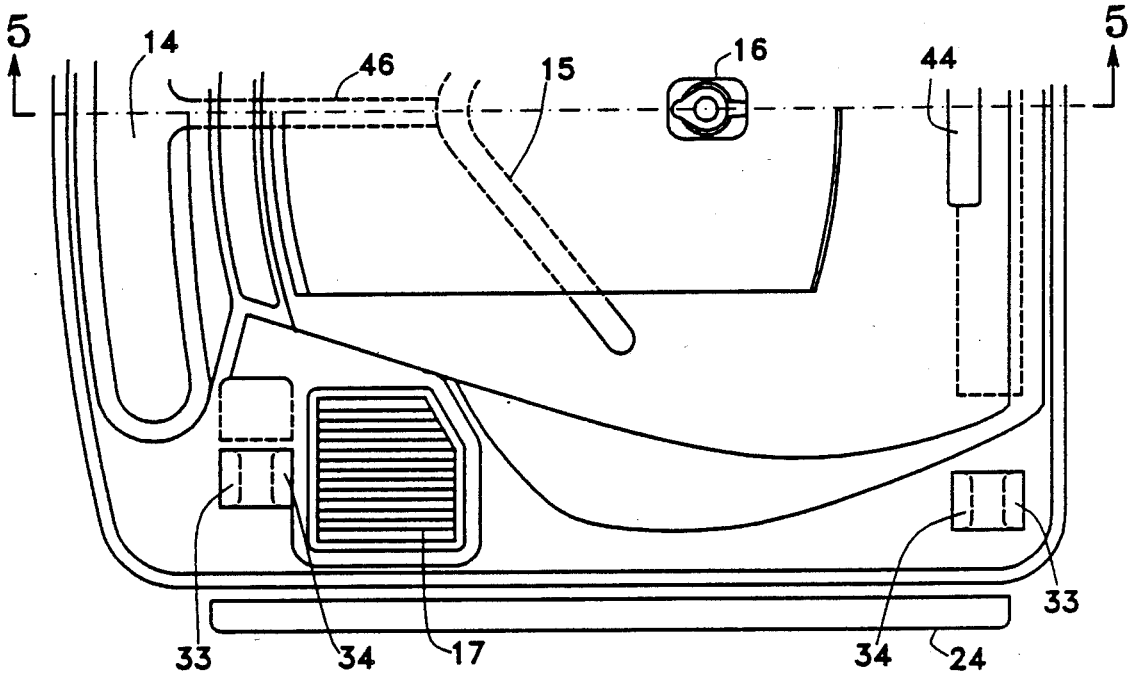
FIG. 4
FIG. 5
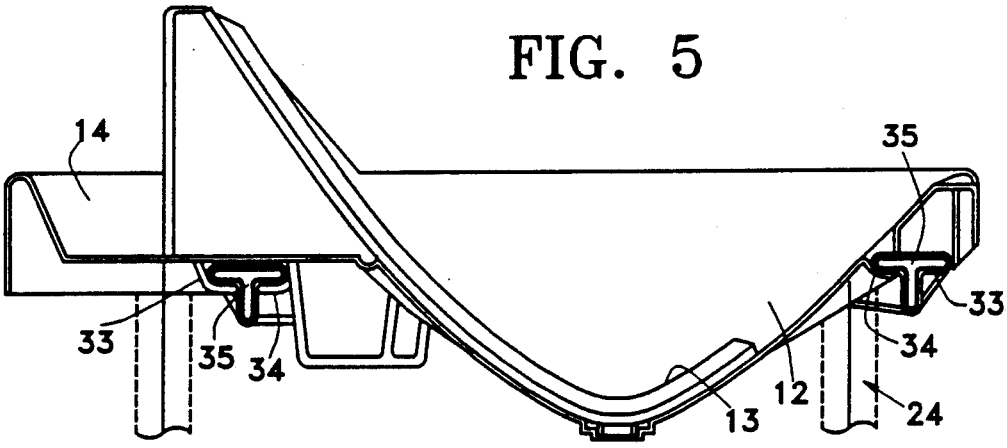

INFANT BATHING APPARATUS

BACKGROUND OF THE INVENTION

1. Field of the Invention

This invention pertains in general to the field of bathing apparatus and in particular to an infant's bathing apparatus which is intended to be used with a conventional bathtub or in the alternative to be used as a free-standing structure.

2. Description of the Prior Art

The bathing of an infant child is a task but is usually one that is enjoyed by the infant as well as the person bathing the child, usually the child's parent. Infant children enjoy the feel and texture of the bath water as well as playing in the water. As a result, the bath water can be expected to splash from within the infant bathing apparatus to the surrounding area wherever the child is being bathed. Accordingly, in the prior art the most convenient bathing device for a child is that of a kitchen sink, wherein some sort of plastic bathtub is utilized. These prior art plastic bathtubs may take on two forms, one of which is a plastic container that simply fits within the sink where the child is being bathed. The other type of prior art sink type of plastic bathtubs are adapted to fit the frame of the sink so that the child and the water will be oriented in a particular direction usually semi-sitting while being bathed.

The kitchen sink type of child bathing apparatus is not always conveniently used in a kitchen sink. The normal schedule of everyday matters may dictate that the kitchen sink be utilized for other purposes at a time for the child's bath. Then, of course, the child must be bathed in a bathtub in a bathroom facility. In these instances the plain plastic tub or the one adapted to fit the kitchen sink is usually not suitable for use within a bathtub. Furthermore, it is very inconvenient for the person bathing the child to have to kneel by the bathtub and extend his upper body and arms into the bathtub and within the child bathing device therein in order to bathe the child. This latter aspect seriously detracts from the enjoyment experienced by the parent and the baby during his bath.

There is another type of prior art infant bathing apparatus which is intended to be fitted within a bathtub and stand substantially waist high so that the person bathing the child does not have to bend over. In this prior art type of bathing apparatus, the child may again enjoy his bath.

However, in the prior art there are no infant bathing devices which conveniently allow the child being bathed and a person bathing the child to simultaneously be bathed together with the child being in an infant bathing apparatus and the adult being in the bathtub. This type of bathing apparatus is advantageous over the prior art in that it allows the adult to be bathed at the same time and thereby avoid time-consuming separate baths. Then too, the person bathing the child need not be concerned with getting wet in any degree or form whatsoever. Another advantage of this type of infant bathing apparatus is that it affords the person bathing the child to be constantly with the child while the child is being bathed and while that person is being bathed and assists in creating an emotional bond between child and adult.

Accordingly, it is a primary object of the present invention to provide an infant bathing apparatus which is adapted to be fitted locatable at a height at or near the rim of a bathtub and being configured in such a manner that it allows the person bathing the child to take a bath simultaneously with the bathing of the child.

Another object of the present invention is to provide infant bathing apparatus which is adapted to be fitted to the rim of a bathtub and alternatively is adapted to be fitted with appendages which fit within a bathtub and thereby provide a substantially rim high bathing arrangement for the infant.

Another object of the present invention is to provide infant bathing apparatus which is lightweight but yet substantially sturdy so as to allow the same to be fitted to the rim of a bathtub in a secure manner and to securely support and position the child.

Another object of the present invention is to provide infant bathing apparatus which allows the bath water to gently enter the bathing cavity in such a manner that the temperature of the water may be sufficiently regulated before entering the bathing cavity and to provide a constant water flow while maintaining the level of water in the bathing apparatus.

Another object of the present invention is to provide infant bathing apparatus with a seating position which is independent of the bathing water cavity so that the child's resting position is not necessarily restricted by the shape of the bathing cavity.

Another object of the present invention is to provide infant bathing apparatus which allows the child being bathed to face the adult person bathing the child whether the adult person is in the bathtub with the child or outside of the bathtub.

The above-stated objects as well as other objects which, although not specifically stated, but are intended to be included within the scope of the present invention, are accomplished by the present invention and will become apparent from the hereinafter set forth Detailed Description of the Invention, Drawings, and the Claims appended herewith.

SUMMARY OF THE INVENTION

The present invention accomplishes the above-stated objectives as well as others, as may be determined from a fair reading of this entire specification, is accomplished by the present invention which provides an infant bathing apparatus adaptable to be located at or near the height of the rim of a bathtub or for fitting onto the rim of a bathtub, or in the further alternative, supported by appendages which are positioned with a bathtub.

The infant bathing apparatus provided by the present invention comprises a bathing cavity portion which includes a seat member for the positioning of the child therein and a separate filling cavity with a trough between the filling cavity and the bathing cavity. A pair of extendable appendages, one on each side portion of the main bathing cavity portion, is slidingly fitted thereto and adjustable in width so that when pulled out the infant bathing apparatus may be securely positioned on top of the rim of a conventional bathtub. The underside of the infant bathing apparatus provided by the present invention includes four shaped depressions, one at each corner of the apparatus, to which may be fitted downwardly extending legs which comprise the extendable appendages but removed from the side of the bathing apparatus and inserted into the underside depressions so as to allow the infant bathing apparatus to be supported by said legs which may be positioned within a conventional bathtub aligned with either the transverse or the longitudinal axis thereof. In the latter embodiment, the extending legs positioned within the infant bathing apparatus can raise the bathing cavity to approximately bathtub rim level. In another embodiment, a combination of downwardly extending legs and an extendable side appendage may be used to support the bathing apparatus within a bathtub.

BRIEF DESCRIPTION OF THE DRAWINGS

Various other objects, advantages, and features of the invention will become apparent to those skilled in the art from the following discussion taken in conjunction with the following drawings, in which:

FIG. 3 is a plan side view of the infant bathing apparatus;

FIG. 4 is a top plan view of one half of the infant bathing apparatus;

FIG. 5 is a side cross-sectional view taken along the line 7—7 of FIG. 5;

DESCRIPTION OF THE PREFERRED EMBODIMENTS

Figure 1:
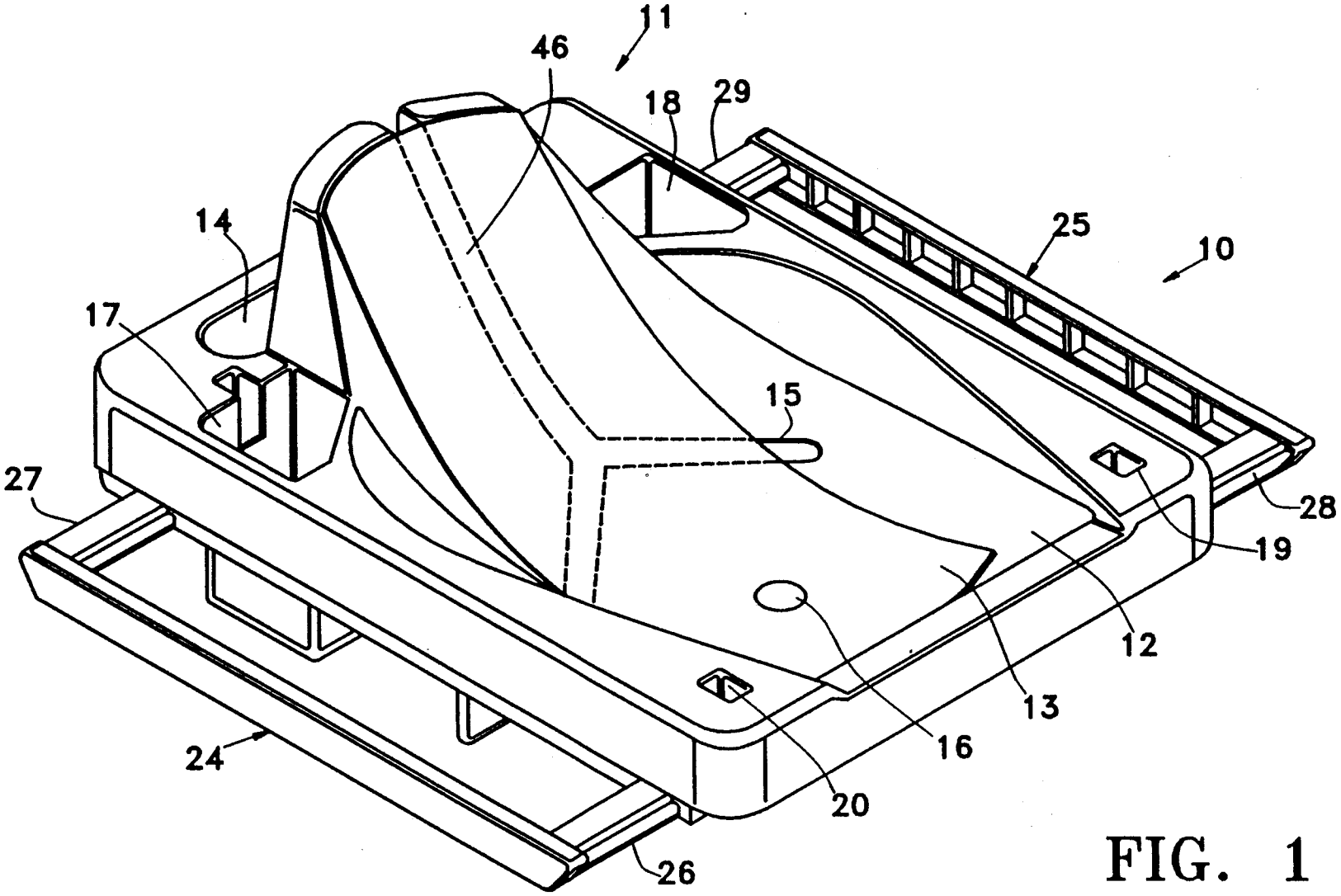
FIG. 1 is an overall isometric view of the inventive infant bathing apparatus.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like of the present invention shown in the characteristics and features various figures are designated by the same reference numerals.

Referring now to the various figures of the drawings, in FIG. 1, an overall isometric view of the infant bathing apparatus 10 is presented. A main body portion 11 includes a cavity 12 for retention of the bath water, a child's positioning member 13, a bath water filling cavity 14, and a trough arrangement 15 for flowing the bath water from filling cavity 14 to bathing cavity 12.

A removable plug means 16 is provided at the lower center portion of the child's seating member, which when opened, allows the bath water to drain from the bathing cavity 12.

A number of convenience cavities 17, 18, 19, and 20 are provided at substantially each corner of the body portion 11 of the infant bathing apparatus 10 for providing a receptacle for such items as baby shampoo, skin lotion, soap, washcloths, and other such like items which are commonly used when bathing an infant.

The entire body portion 11 including all of the members and portions thereof may be molded from a single piece of high density plastic.

On either side of main body portion 11, is positioned a side appendage 24 and 25, respectively, having extending members 26, 27, 28, and 29 which are slidingly received within openings 35 in the underside of the main portion 11. The openings 35 for receiving and extending members 26 through 29 are most clearly seen in FIG. 5 which comprise curved brackets 33 and 34 extending downward from a convenient bottom surface of the frame member 11 having a space 35 therebetween. The downwardly extending curvilinear shape of brackets 33 and 34 with the space 35 therebetween provides an opening which allows extending members 26, 27, 28, or 29 having a tee-shaped cross-sectional shape to slide therein and be supported thereby as seen most clearly in FIGS. 1 and 5 of the drawings.

Figure 2:
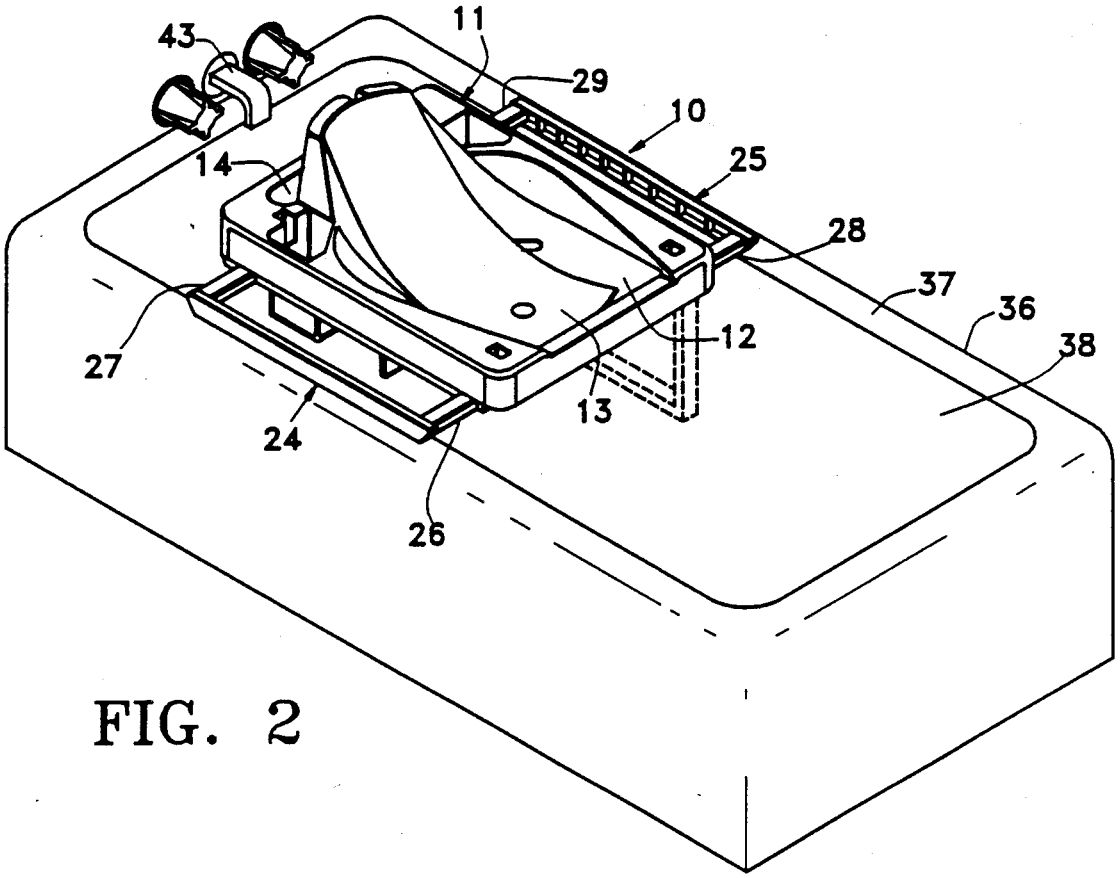
FIG. 2 is an isometric rendering of the infant bathing apparatus adapted to and fitting on the rim of a conventional bathtub.

In FIG. 2 the infant bathing apparatus having side appendages 24 and 25 extending slightly from the main portion 11 child's positioning member aligned with the longitudinal axis of the bathtub. In FIG. 2 it is seen that the main portion 11 of the bathing device is sized to fit within the width opening of bathtub 36 with the bathing cavity extending downwardly therein a predetermined distance. Accordingly, the underside of extending members 26 through 29 rest on top of the rim 37 of bathtub 36. The weight of the infant bathing apparatus 10 in combination with the weight of the water and the weight of the child contained therein when used for bathing purposes,.in addition to the nature of the sliding relationship with extending members 26 through 29 within brackets 33 and 34, are such that the infant bathing apparatus 10 and particularly the main body portion 11 is securely fitted and held in place between the bathtub rim 37 of bathtub 36. It is to be noted that the position of the infant bathing apparatus 10 and the size of the same with regard to bathtub 36 is such that a relatively large opening 38 remains available in bathtub 36. Opening 38 allows the person bathing the child using the infant bathing apparatus 10 to also be bathing within bathtub 36 at the same time. Moreover, the location of a child within the infant bathing apparatus 10 relative to a person bathing within bathtub 36 is such that the baby and adult are longitudinally aligned and the person sitting in the bathtub may easily reach his or her arms within the bathing cavity 12 so as to conveniently bathe the child.

Still referring to FIG. 2, it is seen that the filling cavity 14 is easily positional under a faucet 43 attached to a wall adjacent to bathtub 36. Filling cavity 14 allows the water entering the bathing cavity 12 to be adjusted in temperature before it enters bathing cavity 12.

Figure 6:
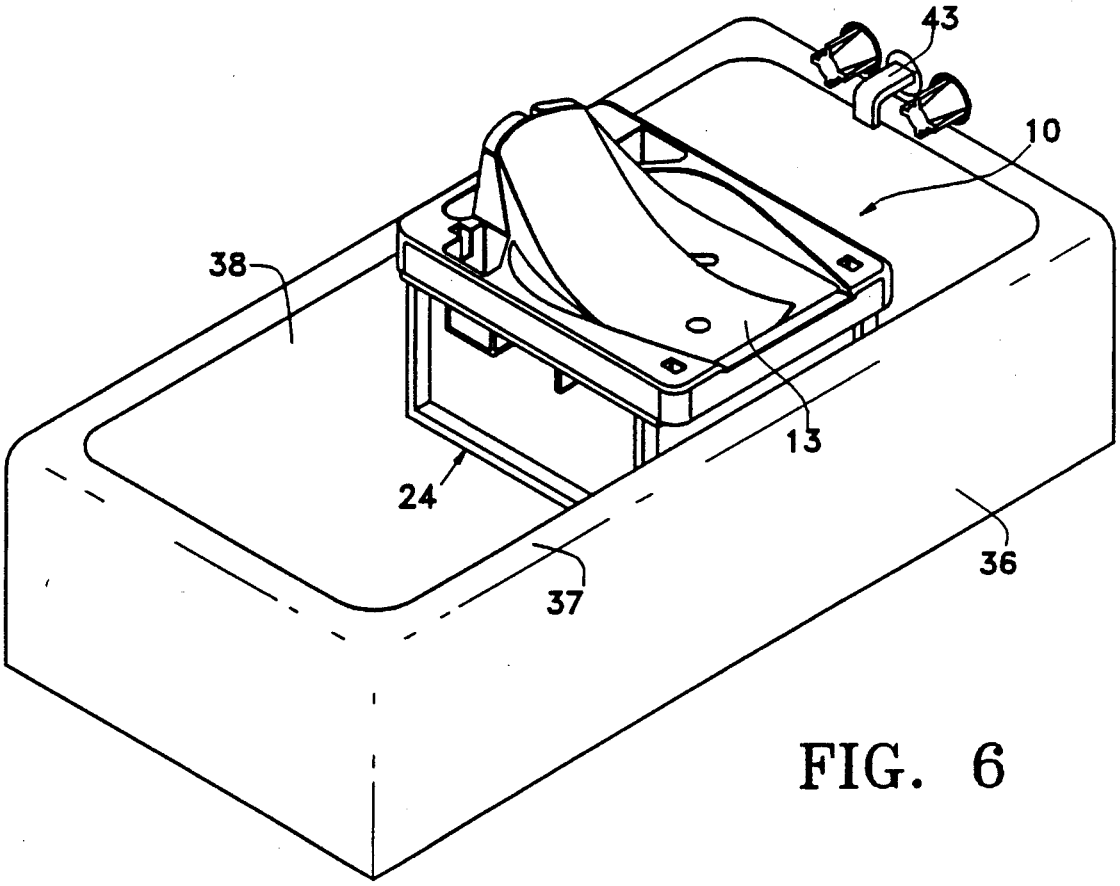
FIG. 6 is an isometric view of the inventive infant bathing apparatus having legs extending down therefrom and fitting transversely within a bathtub.

The embodiments shown in FIG. 6 are those of the infant bathing apparatus 10 being supported upon appendages 24 and 25 which have been removed from the sides of main body portion 11 and fitted to the underside thereof, thereby forming downwardly extending legs. Each of members 26, 27, 28, and 29 of appendages 24 and 25 fit securely within openings 39, which may be molded into the underside of the main body portion 11, of bathing apparatus 10. This may be seen most clearly in FIGS. 3 and FIG. 4 of the drawings. The embodiment shown in FIG. 2 is intended to be used by a person while bathing within bathtub 36. Appendages 24 and 25 are such that they raise the bath 10 to a height of approximately the rim of tub 36. Note, appendages 24 and 25 may also be used for a large size or oversize tub, not showing so that an adult may still bathe with the child in tub 36. Again, in these embodiments, the child's position, as per the position of seating member 13, is toward the person bathing the child who is inside tubs 36 and 56 so as to attain visual contact and therefore promote an emotional bonding experience between child and adult.

In FIGS. 3 through 6 of the drawings, there is shown therein the side, top and back views of the infant bathing apparatus 10. It is to be noted that FIG. 5 is a top view of the bathing apparatus 10. FIG. 4 only show one half of the total view of the bathing apparatus 10. The remaining portions not shown are mirror images of the portions shown.

In FIG. 5 of the drawings, through opening 44 is provided at the foot end of the main body portion 11 for purposes of allowing water to drain from the bathing cavity 12 after the water reaches the height thereof. Further, opening 44 provides a means for allowing a continuous water flow into filling cavity 14, to trough 15, and out of cavity 12 while the height of water therein is maintained at the level of opening 44.

FIG. 5 is a cross-sectional view taken through the line 7—7 of FIG. 4. The relative location of the child's positioning member in relation to the bathing cavity 12 of the bathing apparatus 10 is clearly shown in FIG. 5. The slidingly received fitup of side appendage 25 within the space 35 between brackets 33 and 34 are clearly shown. Filling cavity 14 is flow connected to trough 15 by opening 46 in the back of seating member 13.

While the invention has been described, disclosed, illustrated and shown in certain terms or certain embodiments or modifications which it has assumed in practice, the scope of the invention is not intended to be nor should it be deemed to be limited thereby and such other modifications or embodiments as may be suggested by the teachings herein are particularly reserved especially as they fall within the scope of the breadth and scope of the claims here appended.

We claim as our invention:

1. Portable infant bathing apparatus adapted to be locatable substantially at the level of a rim of a bathtub comprising a main body portion containing an infant seating member and a main bathing cavity, each side of said main bathing portion having a side appendage means slidingly attached to said main body portion and extendable therefrom for resting said infant bathing apparatus on the rim of the bathtub, said side appendage means detachable from said body portion and shaped so as to support said body portion above a floor of a bathtub, a plurality of openings located in the underside of said main body portion and said side appendage means adapted to be mated with said plurality of openings to thereby alternatively support said body portion within a bathtub.

2. The apparatus of claim 1, including a filling cavity positioned behind said infant seating member, said filling cavity being connected to said bathing cavity by a trough therebetween.

3. The apparatus of claim 1, wherein said main body portion is configured to fit between opposite bathtub rims with the infant seating member being positioned longitudinally relative to the longitudinal axis of said bathtub.

4. The apparatus of claim 1, wherein said infant bathing apparatus is configured to leave an opening between said infant bathing apparatus and the bathtub having a size allowing an adult person to fit in said bathtub when the infant bathing apparatus is fitted to the rim of the bathtub.

5. The apparatus of claim 1 wherein said apparatus is adaptable to allow an infant to face another person wherever said person may be situated via said extensible and detachable side appendages

6. The apparatus of claim 2 wherein said filling cavity may be fed a continuous water flow while maintaining an even height of flowing water in said bathing cavity.

7. The bathing apparatus of claim 1 wherein said main body portion includes a water filling cavity, a trough and a bathing cavity wherein said filling cavity, via said trough, may be used to initially fill said bathing cavity and alternatively may be used to provide a continuously flowing source of water to said bathing cavity.

8. The bathing apparatus of claim 1 wherein said main body portion contains as a part thereof, convenience cavities to act a item receptacles.

9. The bathing apparatus of claim 1 wherein said main body portion is suspended upon said removably adaptable legs to permit another person fit underneath said main body portion and within the confines of said bathtub to simultaneously bathe with an infant.

* * * * *